US005427472A

United States Patent [19]

Ono

[11] Patent Number: 5,427,472

[45] Date of Patent: Jun. 27, 1995

[54] UNDERWATER TRUSS STRUCTURE

[76] Inventor: Taisaburo Ono, 351-1 Ninomiya, Ninomiya-machi, Naka-gun, Kanagawa-ken, Japan

[21] Appl. No.: 79,919

[22] Filed: Jun. 23, 1993

[30] Foreign Application Priority Data

Oct. 29, 1992 [JP] Japan ..... 4-291532
Mar. 11, 1993 [JP] Japan ..... 5-050567

[51] Int. Cl.[6] ..... E02B 3/06

[52] U.S. Cl. ..... 405/29; 405/25; 405/21

[58] Field of Search ..... 405/29–31, 405/21, 25, 32–35; 403/171; 52/DIG. 10

[56] References Cited

U.S. PATENT DOCUMENTS 3,864,049 2/1925 Ono ..... 405/30 X
5,054,950 10/1991 Zillgen et al. ..... 403/171
5,310,273 5/1994 Hara ..... 403/171

FOREIGN PATENT DOCUMENTS 52-3487 1/1977 Japan .
58-26443 6/1983 Japan .
0247413 10/1988 Japan ..... 405/29
63-269799 11/1988 Japan .
1180530 7/1989 Japan .

*Primary Examiner*—Dennis L. Taylor
*Attorney, Agent, or Firm*—Sixbey, Friedman, Leedom & Ferguson; Gerald J. Ferguson, Jr.; David S. Safran

[57] ABSTRACT

An underwater truss structure is formed by continuously linking a plurality of unit structures. Each of the unit structures is formed by assembling a plurality of shafts and ball members so as to form a triangle with the ball members respectively positioned at the vertexes of the triangle to connect the shafts at their ends. The shaft includes a compression-resistant tubular member and a tension-resistant tension rod extending inside the tubular member in the axial direction thereof. The tubular member is divided into a plurality of tubular pieces in the longitudinal direction thereof so that they are movable relative to each other in the longitudinal direction of the tubular member and the overall length of the tubular member can be varied by moving the tubular pieces relative to each other in the longitudinal direction of the tubular member. The tension rod is divided into a plurality of rod pieces in the longitudinal direction thereof and the rod pieces are respectively connected to said tubular pieces.

19 Claims, 16 Drawing Sheets

UNDERWATER TRUSS STRUCTURE

BACKGROUND OF THE INVENTION

1. Field of the Invention

This invention relates to an improvement of an underwater truss structure. The underwater truss structure comprises a plurality of shafts jointed by a plurality of ball members. More particularly, the underwater truss structure has a plurality of unit structures which are linked together and each of which comprises a plurality of shafts and ball members assembled so as to form a triangle with the ball members respectively positioned at the corners of the triangle.

2. Description of the Prior Art

The underwater truss structure is a light-weight offshore structure which has been invented by this applicant and can substitute for known offshore structures such as a caisson breakwater, tetrapods and the like which owe their wave damping effect to their weight and are inherently heavy. The underwater truss structure can be installed on sandy or weak ground at low cost and can be used also as a man-made gathering-place for fish. The basic structure of the underwater truss structure is disclosed in Japanese Patent Publication No. 52(1977)-3487 (entitled 'Underwater Truss Structure'). Further as disclosed in Japanese Patent Publication No. 58(1983)-26443 (entitled 'Wave Damping Structure Employing Underwater Truss Structure'), the wave damping effect of the structure can be enhanced by providing brims (disks) on the shafts. Though the wave damping structure disclosed in the patent publication is used as a man-made gathering-place for fish or a substitution for tetrapods, the underwater truss structure can be used for forming various floating structures. An example of such floating structures is disclosed in Japanese Unexamined Patent Publication No. 63(1988)-269799 (entitled 'wave damping stable floating structure' and filed by this applicant).

The underwater truss structure is formed by continuously linking a plurality of unit structures each of which comprising a plurality of shafts and ball members assembled so as to form a triangle, e.g., an equilateral triangle or an isoceles triangle, with the ball members respectively positioned at the corners of the triangle. The shaft comprises a compression-resistant tubular member and a tension-resistant tension rod extending inside the tubular member in the axial direction thereof. The ball member connects the shafts at their ends. When equilateral unit structures are three-dimensionally assembled into an underwater truss structure, twelve shafts are fitted in each of the ball members positioned in the interior of the structure. That is, six shafts are radially connected to the ball member at intervals of 60° in a plane passing through the center of the ball member, and three shafts are connected to the ball member at regular intervals to radially extend upward at 60° to the plane and another three shafts are connected to the ball member at regular intervals to radially extend downward at 60° to the plane.

The wave damping effect of the underwater truss structure used as a wave damping structure or a wave trap can be explained as follows. That is, when waves pass through the underwater truss structure, motion of the waves is disturbed by the resistance due to the shape of the structure and is led to a turbulent state depending on the volume of the underwater truss structure. Turbulence is a flow in which swirls of various sizes are mixed in confusion, and each of large swirls is divided into smaller swirls and each of the smaller swirls is divided into further smaller swirls due to the shape of the structure. The kinetic energy of the swirls which is transmitted in the course of such stepwise divisions from a large swirl to smaller swirls (in the course of cascade type divisions) is finally converted into other energies such as heat in the region where the viscous friction of water prevails, and vanishes from the fluid system.

That is, the underwater truss structure exerts wave damping effect by contacting wave fluid and disturbing it to lead it into a turbulent state, thereby promoting cascade type divisions of swirls and converting the kinetic energy of waves into other energies such as heat.

Accordingly if the cascade type divisions can be promoted more effectively, more kinetic energy is consumed due to the internal resistance of the fluid itself and the resistance to which the structure is subjected is reduced, which is advantageous in view of the strength of the structure. Further the wave damping capacity is increased and accordingly the structure can be smaller in size, whereby cost of the structure can be greatly lowered.

The conventional underwater truss structure which is formed by combination of regular triangular pyramid or regular square pyramid three-dimensional unit structures solely consisting of shafts and ball members (will be referred to as "the normal three-dimensional unit structure", hereinbelow) has a contact area per unit volume with the flow of water which is insufficient to effectively promote the cascade type division and accordingly must be large in scale in order to obtain a desired wave damping effect. Previously, this applicant has proposed to provide a brim on the shaft in order to increase the contact area with the flow of water of the structure (Japanese Patent Publication No. 58(1983)-26443). That is, the underwater truss structure disclosed in the patent publication has three-dimensional unit structures each comprising a plurality of brimmed shafts and a plurality of ball members (will be referred to as "the brimmed three-dimensional unit structure", hereinbelow). The brims on the shafts contribute to large increase in the contact area with fluid per unit volume and to large increase in the wave damping capacity, whereby the underwater truss structure can be small in scale.

In order to improve efficiency in assembly of the underwater truss structure, the structure must be able to be easily assembled.

Further since the underwater truss structure is generally used offshore, parts of the structure are subjected to very large compression and/or tension, and accordingly the structure must be as great as possible in strength.

As described above, the shafts are connected by way of the ball member, the shafts and the ball member must be connected so that both the compression force imparted to the tubular member of each shaft and the tensile force acting on the tension rod of each shaft are transmitted to other shafts. For this purpose, the tension rod of the shaft which resists tensile force must be firmly fixed to the part of the ball member which resists tensile force so that they are not moved away from each other, and at the same time the end of the tubular member of the shaft which resists compression force and the part of the ball member which resists compression force must be kept in a state where they are in abutment against each other not to adversely affect the connection between the tension rod and the part of the ball member which resists tensile force when a compression force is applied thereto. In this specification, the expression "the end of the tubular member and the part of the ball member which resists compression force are in abutment against each other" should be broadly interpreted to include states where they are directly abut against each other and where they are abut against each other with another member sandwiched therebetween, and such a state of connection will be referred to as "the state of proper connection", hereinbelow.

However since the shaft and the ball member are substantially heavy in weight and at the same time, the distance between the ball members comes to be fixed as the assembly progresses, great difficulties are encountered in three-dimensionally assembling the shafts and the ball members into the underwater truss structure while keeping the state of proper connection between the shafts and the ball members. Thus there is a demand for an underwater truss structure which can be assembled easily and efficiently.

Further there are some problems in the brimmed three-dimensional structure. That is, since the brim is provided on the shaft to extend in the direction substantially perpendicular to the axis of the shaft, bending moment as well as an axial force acts on the shaft due to the pressure of water flow acting on the face of the brim if the brim is fixedly connected to the shaft. Accordingly, to widen the area of each brim and/or to increase the number of brims to be provided on each shaft in order to increase contact area with the flow of water can result in excessively large bending moment and axial force acting on the shaft as well as increase in cost and has been difficult to put into practice.

In order to overcome such problems, this applicant has proposed to resiliently connect the brim to the shaft so that the pressure impact imparted to the brim from the flow of water is damped before transmitted to the shaft. See, for instance, Japanese Unexamined Patent Publication No. 1(1989)-180530. However with this arrangement, there still remain problems of enhancement of the brim against the pressure of the flow of water and prevention of axial displacement of the brim relative to the shaft.

Further, in addition to these problems, since the number of brims which can be provided on one shaft is limited, the contact area per unit volume with water can be increased to only a limited extent solely by the brimmed structure.

Thus there has been a demand for a new type three-dimensional unit structure in which the contact area per unit volume can be larger than in the normal three-dimensional unit structure and at the same time which is in a form different from the brimmed three-dimensional unit structure and can be combined with the brimmed three-dimensional unit structure to further increase the contact area per unit volume, thereby more effectively promoting cascade type divisions of swirls.

SUMMARY OF THE INVENTION

In view of the foregoing observations and description, the primary object of the present invention is to provide an underwater truss structure which can be assembled easily and efficiently.

Another object of the present invention is to provide an underwater truss structure having a sufficient strength which can withstand high tensile force and high compression force.

Still another object of the present invention is to provide an underwater truss structure which can be easily assembled while keeping the state of proper connection between the shafts and the ball members.

Still another object of the present invention is to provide an underwater truss structure which is formed by combination of the brimmed three-dimensional unit structures and different three-dimensional unit structures and exhibits excellent wave damping effect.

In accordance with a first aspect of the present invention, there is provided an underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod extending inside the tubular member in the axial direction thereof, characterized in that said tubular member is divided into a plurality of tubular pieces in the longitudinal direction thereof so that they are movable relative to each other in the longitudinal direction of the tubular member and the overall length of the tubular member can be varied by moving the tubular pieces relative to each other in the longitudinal direction of the tubular member, and said tension rod is divided into a plurality of rod pieces in the longitudinal direction thereof and the rod pieces are respectively connected to said tubular pieces.

With this arrangement, the length of the shaft can be adjusted when it is connected to the ball member and accordingly assembly of the underwater truss structure is facilitated and can be effected at high efficiency.

In accordance with a second aspect of the present invention, there is provided an underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod extending inside the tubular member in the axial direction thereof, characterized in that said tension rods of the shafts are connected through the center of the ball member.

With this arrangement, a tensile force applied to each tension rod can be transmitted and dispersed to many other tension rods and accordingly, the underwater truss structure can withstand great tensile force and/or compression force.

In accordance with a third aspect of the present invention, an end portion of the tension rod is movable relative to the tubular member in the longitudinal direction thereof to be retracted in the tubular member and to be projected from the end of the tubular member and the end portion of the tension rod extends into the ball member and is connected to a connecting means provided in the ball member. Preferably the connecting means releasably holds the end portion of the tension rod. For example, the connecting means comprises a pair of engaging pieces which are provided on the end portion of the tension rod to be movable toward and away from each other respectively to a closed position and an open position and a sleeve member which is provided inside the ball member and into which the end portion of the tension rod is inserted, the sleeve member having a small diameter portion at its outer end with an engaging shoulder formed between the larger diameter portion and the small diameter portion, and said engaging pieces permitting the end portion of the tension rod to be freely inserted into and drawn out of the sleeve member when they are in the closed position and engaging with said engaging shoulder to prevent the end portion of the tension rod to be drawn out of the sleeve member when they are in the open position. Preferably the engaging pieces can be controlled from outside the shaft by means of an actuator and more preferably at least a part of the actuator is exposed outside the shaft so that the position of the engaging pieces can be known from outside on the basis of the state of the part.

Such an arrangement further facilitate assembly of the underwater truss structure.

In accordance with a fourth aspect of the present invention, the tubular member comprises a main body and an end piece which is connected to the main body to be movable relative to the main body in the longitudinal direction of the tubular member, and the tension rod comprises a main body and an end piece which are respectively connected to the main body and the end piece of the tubular member. Further said ball member has an abutment portion which abuts against the end face of the end piece of the tubular member to position the end piece relative to the ball member and support the shaft against a compression force, and an anchoring portion which extends in the ball member and is connected to the end piece of the tension rod to support the tension rod against a tensile force. There is provided a connecting member which is mounted on one of the end piece of the tension rod and the anchoring portion to be movable relative thereto in the longitudinal direction thereof, and an actuator which is operatively connected to the connecting member at one end and the other end of which projects outside between the abutment portion of the ball member and the end piece of the tension rod in the state where they are in abutment against each other.

With this arrangement, the operation of positioning the shaft relative to the ball member and the operation of connecting the end piece of the tension rod to the anchoring portion of the ball member can be separately effected. That is, when the shaft is connected to the ball member, the overall length of the shaft is first adjusted so that the end face of the end piece of the tubular member is brought into abutment against the abutment portion of the ball member, and then the actuator is operated from outside to move the connecting member in the longitudinal direction and cause it to connect the end piece of the tension rod to the anchoring portion.

Thus the shaft can be easily connected to the ball member in the state of proper connection. In this regard, if the shaft is only telescopic, the operation of positioning the shaft relative to the ball member and the operation of connecting the end piece of the tension rod to the anchoring portion of the ball member must be performed simultaneously, which is very difficult to put into practice.

DESCRIPTION OF THE PREFERRED EMBODIMENTS

Figure 1:
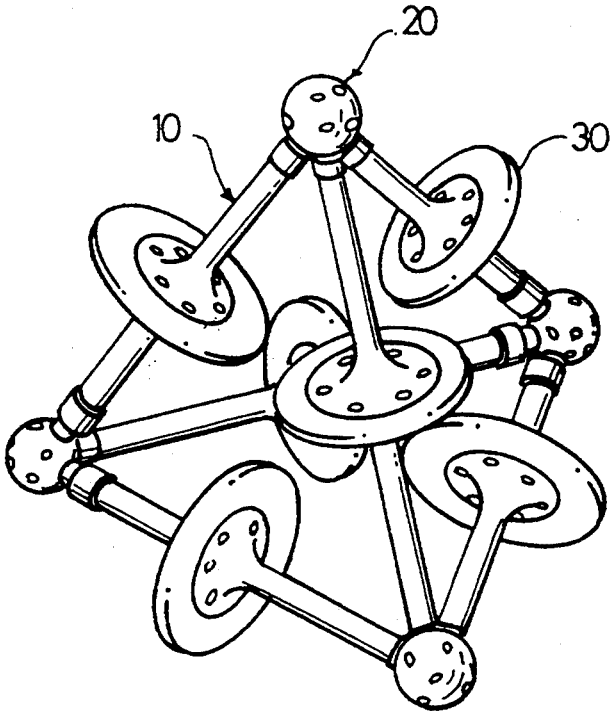
FIG. 1 is a perspective view showing a three-dimensional unit structure of an underwater truss structure in accordance with a first embodiment of the present invention.

An underwater truss structure in accordance with a first embodiment of the present invention has a plurality of three-dimensional unit structures linked together, and one of the three-dimensional unit structures is shown in FIG. 1. As shown in FIG. 1, the three-dimensional unit structure comprises a plurality of shafts 10 and ball members 20 which connect the shafts 10 at their ends. The shafts 10 and the ball members 20 are assembled so as to form a regular tetrahedron with the ball members 20 respectively positioned at the vertexes.

Each of the shafts 10 is provided with a brim 30 for enhancing the wave damping effect. Though each shaft 10 may be provided with one brim 30, it is preferably provided with three brims in order to further enhance the wave damping effect, one larger than the other two and disposed at the middle of the shaft 10 and the other two disposed on opposite sides of the larger one. Such an arrangement is disclosed in detail in Japanese Patent Publication No. 58(1983)-26443.

Figure 2:
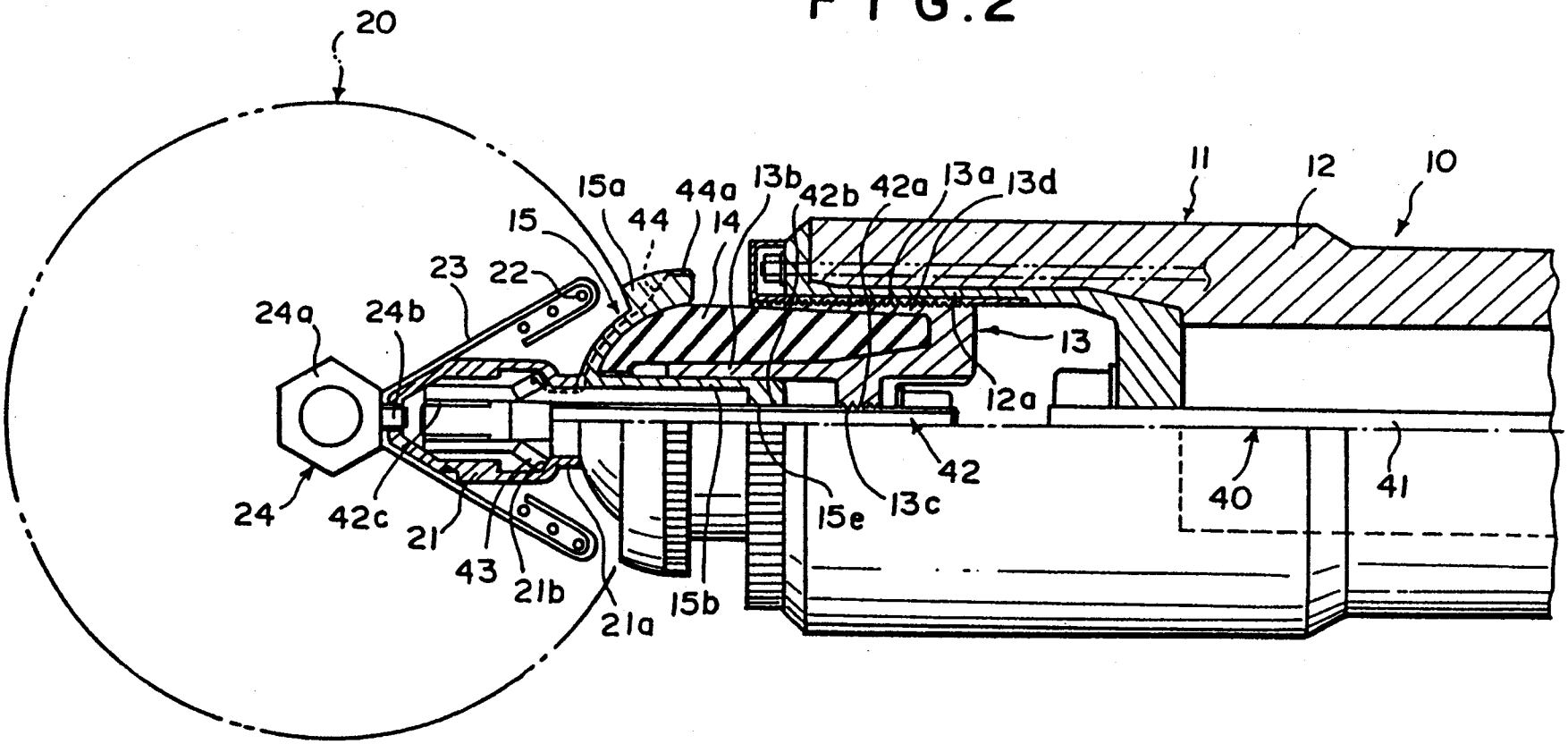
FIG. 2 is a side view partly in cross-section of an end portion of the shaft which is employed in the underwater truss structure in accordance with the first embodiment of the present invention.
Figure 3:
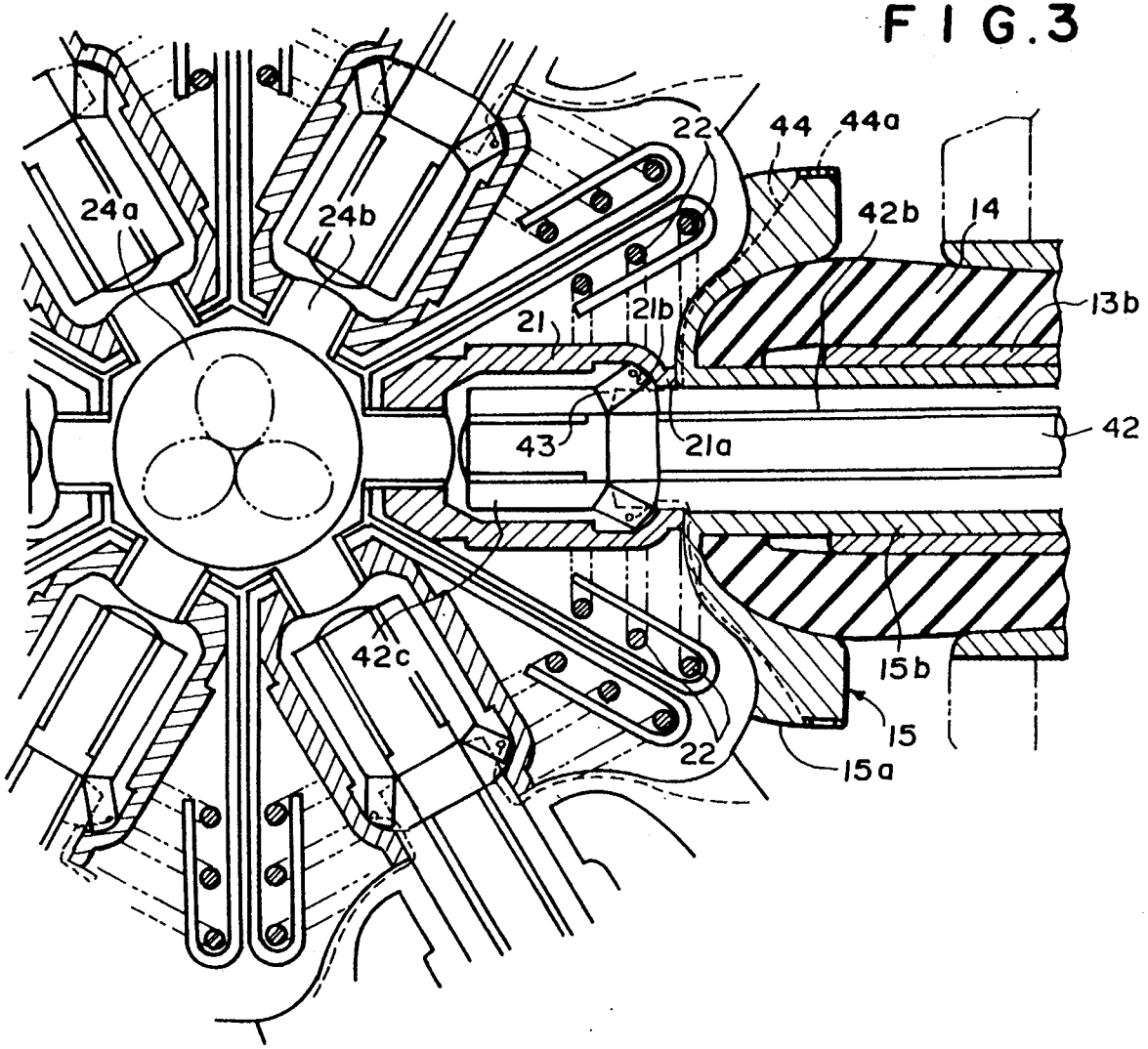
FIG. 3 is a cross-sectional view of the ball member which is employed in the underwater truss structure in accordance with the first embodiment of the present invention.

As shown in FIG. 2, the shaft 10 comprises a compression-resistant tubular member 11 and a tension-resistant tension rod 40 extending inside the tubular member 11 in the axial direction thereof. The tubular member 11 comprises a main body 12 and a pair of end pieces 13 which are screwed into respective end portions of the main body 12 so that the overall length of the tubular member 11 can be varied by rotating the main body 12 and each of the end pieces 13 relative to each other. Though only one end portion of the shaft 10 is shown in FIGS. 2 and 3, the end portions are the same in structure. The tension rod 40 is divided in the longitudinal direction thereof into a main body 41 and a pair of end pieces 42 which are respectively connected to the main body 12 and the end pieces 13 of the tubular member 11.

As can be seen from FIG. 2, the main body 12 of the tubular member 11 has a cylindrical recess in each of the end portions. The cylindrical recess extends in the longitudinal direction of the tubular member 11 and is provided with a thread 12*a* on the inner surface thereof. The end piece 13 comprises an outer cylindrical portion 13*d* and an inner cylindrical portion 13*b* which are formed coaxially with each other. The outer cylindrical portion 13*d* has a cylindrical outer surface which is provided with a thread 13*a* adapted to be engaged with the thread 12*a*. Thus the overall length of the tubular member 11 can be varied by rotating the main body 12 and the end piece 13 relative to each other. Since the main body 41 and the end piece 42 of the tension rod 40 are respectively connected to the main body 12 and the end piece 13 of the tubular member 11 and moved toward and away from each other when the main body 12 and the end piece 13 of the tubular member 11 are rotated relative to each other to vary the overall length of the tubular member 11, the effective length of the tension rod 40 can also be varied.

The inner cylindrical portion 13*b* extends toward the ball member 20 beyond the end of the outer tubular portion 13*d* along the end piece 42 of the tension rod 40. The inner cylindrical portion 13*b* of the end piece 13 has a recess which extends in the longitudinal direction of the end piece 13 and opens toward the ball member 20. The end piece 13 has a bore at the bottom of the recess in the inner cylindrical portion 13*b*. The bore is formed coaxially with the recess in the inner cylindrical portion 13*b* and has a diameter smaller than that of the recess. A thread 13*c* adapted to be engaged with a thread 42*a* formed on the outer surface of the end piece 42 of the tension rod 40 is formed on the inner peripheral surface of the bore in the end piece 13 of the tubular member 11. A tubular resilient member 14 formed of rubber, elastomer or the like is fitted on the inner cylindrical portion 13*b* of the end piece 13 between the outer peripheral surface of the inner cylindrical portion 13*b* and the inner peripheral surface of the outer cylindrical portion 13*d* of the end piece 13. A rotary member 15 comprising a cup-like front end portion 15*a* and a tubular central portion 15*b* is fitted on the end of the shaft 10 so that the cup-like front end portion 15*a* receives the end portion of the resilient member 14 and the tubular central portion 15*b* is slidably received in the recess of the inner cylindrical portion 13*b* of the end piece 13 and extends along the outer peripheral surface of the end piece 42 of the tension rod 40. A key portion 15*e* is formed on the inner peripheral surface of the tubular central portion 15*b* at the free end portion thereof. The key portion 15*e* is engaged with a keyway 42*b* formed on the outer peripheral surface of the end piece 42 of the tension rod 40 to extend in the longitudinal direction thereof so that the central portion 15*b* is movable in the longitudinal direction of the end piece 42 in the keyway 42*b*. Accordingly rotation of the rotary member 15 is transmitted to the end piece 42 and axial movement of the same is not transmitted to the end piece 42.

When the rotary member 15 is rotated relative to the end piece 13 of the tubular member 11, the end piece 42 of the tension rod 40 is rotated relative to the end piece 13 and is moved in the longitudinal direction of the tubular member 11 relative to the end piece 13 by way of the engagement between the thread 42*a* on the end piece 42 and the thread 13*c* on the end piece 13, whereby the length of the end portion 42*c* of the end piece 42 projecting from the end of the tubular member 11 can be varied.

Further when the rotary member 15 and the end piece 13 of the tubular member 11 are rotated together, the end piece 42 of the tension rod 40 is not rotated relative to the end piece 13 and accordingly it is not moved in the longitudinal direction of the tubular member 11. In this case, the end piece 13 of the tubular member 11 together with the end piece 42 of the tension rod 40 is rotated relative to the main body 12 of the tubular member 11 and is moved in the longitudinal direction of the tubular member 11 by way of the engagement between the threads 12*a* and 13*a*, whereby the overall length of the shaft 10 is varied.

The end portion 42*c* of the end piece 42 projecting from the end of the tubular member 11 is fitted in one of twelve sleeves 21 provided in the ball member 20. Each sleeve 21 extends in a radial direction of the ball member 20 and has a small diameter portion 21*a* at its outer end with an engaging shoulder 21*b* formed between the larger diameter portion and the small diameter portion 21*a*. The end portion 42*c* of the end piece 42 is provided with a pair of engaging pieces 43 which can be moved toward and away from each other respectively to a closed position and an open position by externally actuating a control wire 44. When the engaging pieces 43 are in the closed position, the end portion 42*c* can be freely inserted into and drawn out of the sleeve 21. When the engaging pieces 43 are opened with the end portion 42*c* in the sleeve 21 as shown in FIGS. 2 and 3, the engaging pieces 43 are engaged with the engaging shoulder 21*b* of the sleeve 21 to prevent the end portion 42*c* from being drawn out.

The outer end 44*a* of the control wire 44 is positioned outside the rotary member 15 so that the engaging pieces 43 can be actuated from outside and the position of the engaging pieces 43 can be known from the position of the outer end 44*a*.

The space around the sleeve 21 is concreted and the concrete is reinforced with three steel rings 22 which are engaged with a support member 23. The support member 23 is connected to an anchor ring 24 fixed at the center of the ball member 20. The anchor ring 24 comprises an annular portion 24*a* and six protrusions 24*b* provided on the outer surface of the annular portion 24*a*. The sleeve 21 and the support member 24 are connected to one of the protrusions 24*b* at their bases.

The outer surfaces of the rotary member 15 and the end piece 13 of the tubular member 11 are knurled in order to facilitate rotation thereof.

Though, in this embodiment, each of the tubular member 10 and the tension rod 40 is divided into three pieces, it may be divided into two pieces. That is, each of the tubular member 10 and the tension rod 40 may have an end piece only at one end thereof. Further, each of the tubular member 10 and the tension rod 40 may by divided into more than three pieces.

Now a second embodiment of the present invention will be described with reference to FIGS. 4 to 9.

The underwater truss structure in accordance with the second embodiment of the present invention has a plurality of three-dimensional unit structures each of which is the same as that in the first embodiment in the combination of the shafts and the ball members but differs from that in the first embodiment in the structure of the shaft and the ball member.

In FIGS. 4 to 9, the shaft is indicated at 110 and the ball member is indicated at 120.

Figure 4:
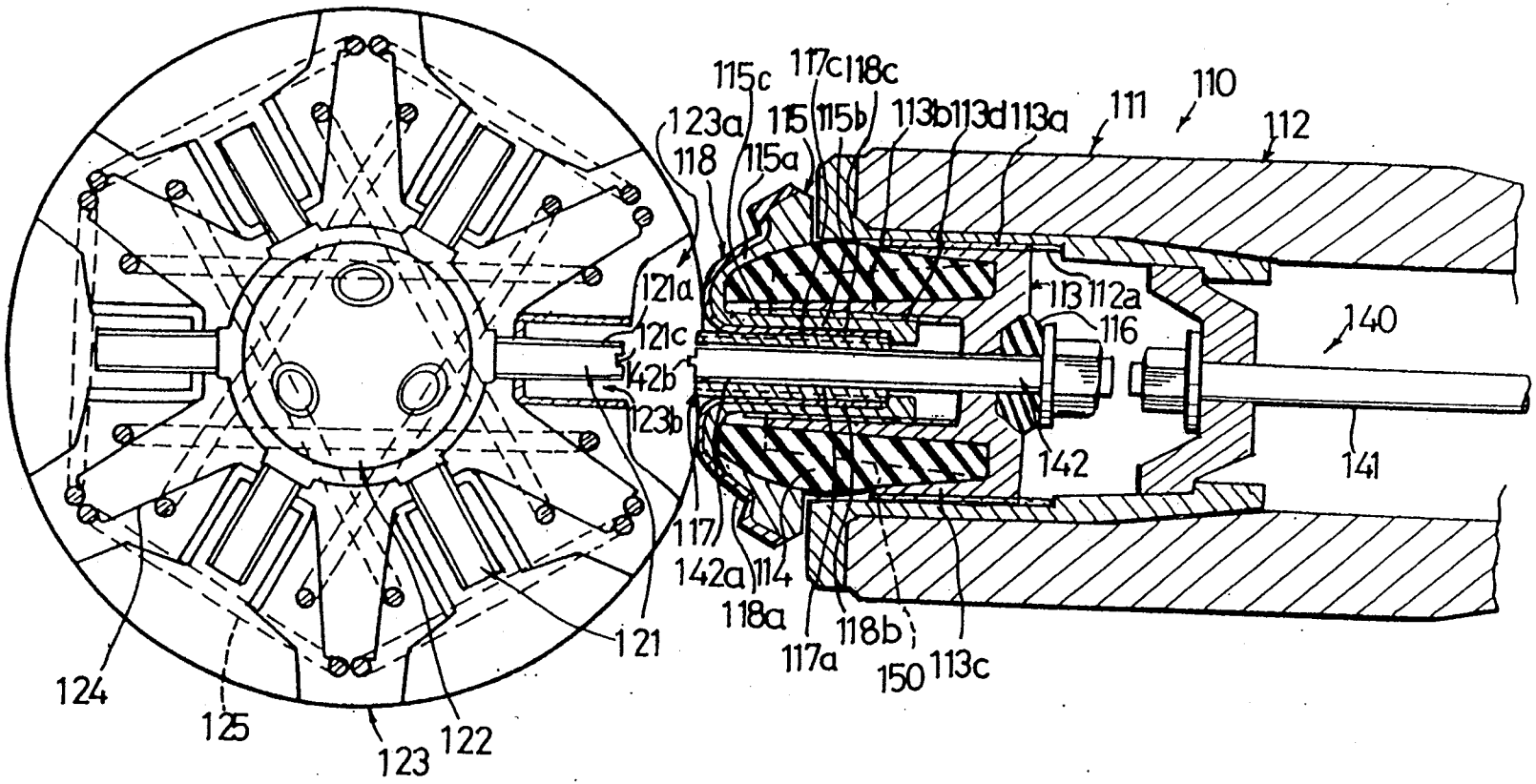
FIG. 4 is a cross-sectional view showing an end portion of the shaft and the ball member employed in the underwater truss structure in accordance with a second embodiment of the present invention.

The shaft 110 comprises a compression-resistant tubular member 111 and a tension-resistant tension rod 140 extending inside the tubular member 111 in the axial direction thereof. The tubular member 111 comprises a main body 112 and a pair of end pieces 113 which are screwed into respective end portions of the main body 112 so that the overall length of the tubular member 111 can be varied by rotating the main body 112 and each of the end pieces 113 relative to each other. Though only one end portion of the shaft 110 is shown in FIG. 4, the end portions are the same in structure. The tension rod 140 is divided in the longitudinal direction thereof into a main body 141 and a pair of end pieces 142 which are respectively connected to the main body 112 and the end pieces 113 of the tubular member 111.

As can be seen from FIG. 4, the main body 112 of the tubular member 111 has a cylindrical recess in the end portion facing the end piece 113. The cylindrical recess extends in the longitudinal direction of the tubular member 111 and is provided with a thread **112*a* on the inner surface thereof. The end piece 113 comprises an outer cylindrical portion 113*c* and an inner cylindrical portion 113*b* which are formed coaxially with each other. The outer cylindrical portion 113*c* has a cylindrical outer surface which is provided with a thread 113*a* adapted to be engaged with the thread 112*a*. Thus the overall length of the tubular member 111 can be varied by rotating the main body 112 and the end piece 113 relative to each other. Since the main body 141 and the end piece 142 of the tension rod 140 are respectively connected to the main body 112 and the end piece 113 of the tubular member 111 and moved toward and away from each other when the main body 112 and the end piece 113 of the tubular member 111 are rotated relative to each other to vary the overall length of the tubular member 111, the effective length of the tension rod 140** can also be varied.

A tubular resilient member 114 formed of rubber, elastomer or the like is fitted on the inner cylindrical portion **113*b* of the end piece 113 between the outer peripheral surface of the inner cylindrical portion 113*b* and the inner peripheral surface of the outer cylindrical portion 113*c* of the end piece 113. The inner cylindrical portion 113*b* of the end piece 113 has a recess which extends in the longitudinal direction of the end piece 113 and opens toward the ball member 120. A first actuator 115 comprising a cup-like front end portion 115*a* and a tubular central portion 115*b* is fitted on the end of the shaft 110 so that the cup-like front end portion 115*a* receives the end portion of the resilient member 114 and the tubular central portion 115*b* is slidably received in the recess of inner cylindrical portion 113*b* of the end piece 113 and extends along the outer peripheral surface of the end piece 142 of the tension rod 140. A key portion 115*c* is formed on the outer peripheral surface of the tubular central portion 115*b* at the free end portion thereof. The key portion 115*c* is engaged with a keyway 113*d* formed on the inner peripheral surface of the inner cylindrical portion 113*b* of the end piece 113*b* to extend in the longitudinal direction of the tubular member 111 so that the central portion 115*b* is movable relative to the end piece 113 in the longitudinal direction thereof. Accordingly rotation of the central portion 115*b* of the first actuator 115 is transmitted to the end piece 113 and axial movement of the same is not transmitted to the end piece 113. A suitable number of reinforcement ribs 150 are provided on the outer peripheral surface of the inner cylindrical portion 113*b* of the end piece 113**.

Figure 5:
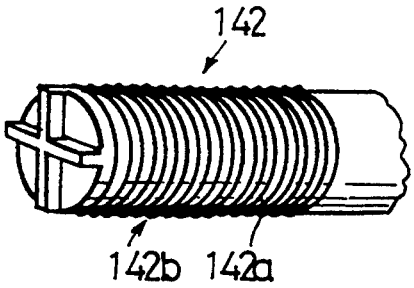
FIG. 5 is a perspective view showing an end portion of the end piece of the tension rod employed in the second embodiment.
Figure 6:
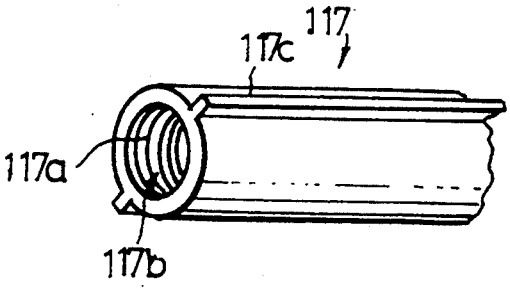
FIG. 6 is a perspective view showing an end portion of the connecting member employed in the second embodiment.

As shown in FIG. 4, the end piece 142 of the tension rod 140 is mounted on the end piece 113 of the tubular member 111 by way of a resilient member 116 formed of rubber, elastomer or the like with a slight play in the longitudinal direction of the tubular member 111. A first thread **142*a* is formed on the outer peripheral surface 142*b* of the outer end portion of the end piece 142 as shown in FIG. 5. A tubular connecting member 117 is provided with a second thread 117*a* formed on the inner peripheral surface 117*b* thereof as shown in FIG. 6. The second thread 117*a* is adapted to be engaged with the first thread 142*a*, and the connecting member 117 is screwed on the outer end portion of the end piece 142 so that the amount of projection of the connecting member 117 from the outer end of the end piece 142 can be varied by rotating the connecting member 117 relative to the end piece 142. Further as shown in FIG. 6, a pair of keys 117*c* are formed on the outer peripheral surface of the connecting member 117 to extend in the longitudinal direction thereof. A second actuator 118 comprises cup-like front end portion 118*a* which receives the front end portion 115*a* of the first actuator 115 and a tubular central portion 118*b* which is fitted in the tubular central portion 115*b* of the first actuator 115 so that the second actuator 118 is rotatable relative to the first actuator 115. A pair of keyways 118*c* are formed on the inner peripheral surface of the tubular central portion 118*b* of the second actuator 118 to extend in the longitudinal direction thereof and the keys 117*c* on the connecting member 117 are in engagement with the keyways 118*c* so that the connecting member 117 can be moved in the longitudinal direction of the second actuator 118**.

When the first actuator 115 is rotated together with the second actuator 118 relative to the main body 112 of the tubular member 111, the end piece 113 is rotated relative to the main body 112 and is moved in the longitudinal direction of the tubular member 111 relative to the main body 112 by way of the engagement between the threads **112*a* and 113*a*. At this time, since the connecting member 117, the second actuator 118 and the end piece 142 are rotated relative to the main body 112 together with the end piece 113, the connecting member 117 is not rotated relative to the end piece 142 of the tension rod 140. On the other hand, when the second actuator 118 is rotated relative the first actuator 115** with the latter held stationary, the connecting member 117 is rotated relative to the end piece 142 and is moved in the longitudinal direction of the tubular member 111 relative to the end piece 142 by way of the engagement between the first and second threads 142*a* and 117*a*.

Figure 7:
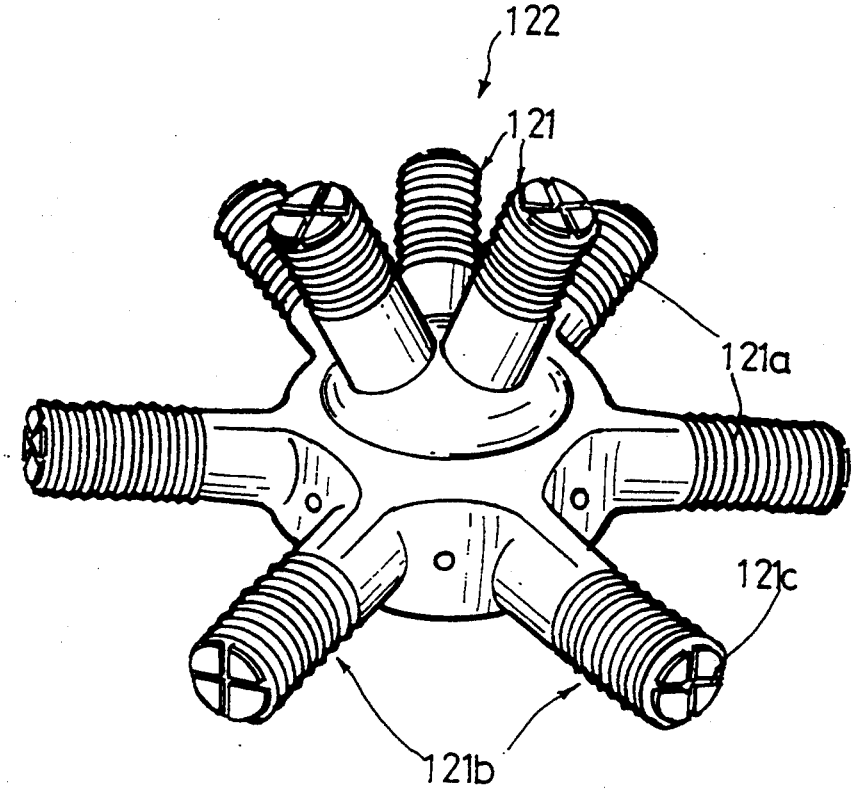
FIG. 7 is a perspective view showing the tension block employed in the second embodiment.

The ball member 120 comprises a tension block 122 and a concrete surrounding portion 123 formed around the tension block 122. The surrounding portion 123 is reinforced with steel rings 125 supported by a support member 124. As shown in FIG. 7, the tension block 122 is provided with twelve anchoring portion 121.

As shown in FIG. 4, the surrounding portion 123 is provided with twelve shaft-bearing portions each comprising an abutment portion 123*a* in the form of a recess formed on the outer peripheral surface of the surrounding portion 123 and a sleeve portion 123*b* in the form of a cylindrical recess which extends toward the center of the ball member 120 from the bottom of the abutment portion 123*a*. When the shaft 110 is connected to the ball member 120, the front end of the shaft 110, i.e., the front end face of the second actuator 118 is brought into abutment against the abutment portion 123*a* and is positioned relative to the ball member 120. One of the anchoring portions 121 extends outward through the sleeve portion 123*b*. As shown in FIG. 7, the outer end portion of the anchoring portion 121 is provided on its outer surface 121*b* with a thread 121*a* which is adapted to be engaged with the thread 117*a* on the connecting member 117. Further a cross-shaped recess 121*c* adapted to be engaged with a cross-shaped protrusion 142*b* formed on the front end face of the end piece 142 is formed on the outer end face of the anchoring portion 121.

The shaft 110 is connected to the ball member 120 in the following manner.

Figure 8:
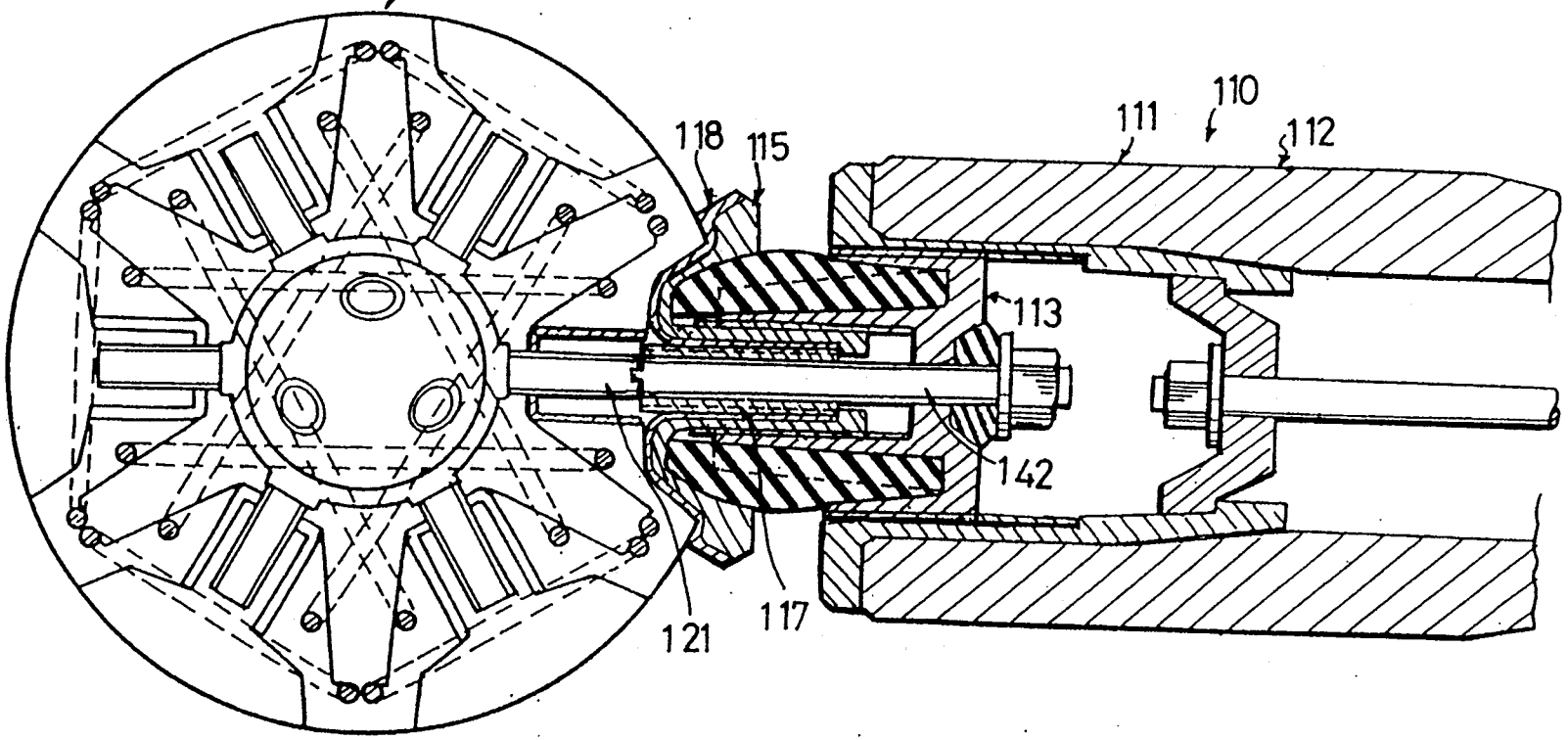
FIG. 8 is a view similar to FIG. 4 but showing the state in which the front end of the shaft is in abutment against the ball member.

With the end of the shaft 110 positioned near the abutment portion 123*a* of the ball member 120 as shown in FIG. 4, the first actuator 115 and the second actuator 118 are rotated integrally with each other to rotate the end piece 113 and the end piece 142 relative to the main body 112 of the tubular member 111 so that the end piece 113 is moved relative to the main body 112 toward the ball member 120 until the front end face of the shaft 110, i.e., the front end face of the second actuator 118, abuts against the abutment portion 123*a* of the ball member 120, whereby the shaft 110 is positioned relative to the ball member 120 so that the end piece 142 is aligned with the anchoring portion 121 of the ball member 120 with the cross-shaped protrusion 142*b* of the end piece 142 engaged with the cross-shaped recess 121c of the anchoring portion 121 as shown in FIG. 8. Though the end piece 142 is rotated together with the end piece 113 and moved toward the ball member 120 until the cross-shaped protrusion 142*b* is brought into engagement with the cross-shaped recess 121*c*, when the cross-shaped protrusion 142*b* is once engaged with the cross-shaped recess 121*c*, rotation of the end piece 142 is prevented and accordingly rotation of the end piece 113 relative to the main body 112 is prevented.

Figure 9:
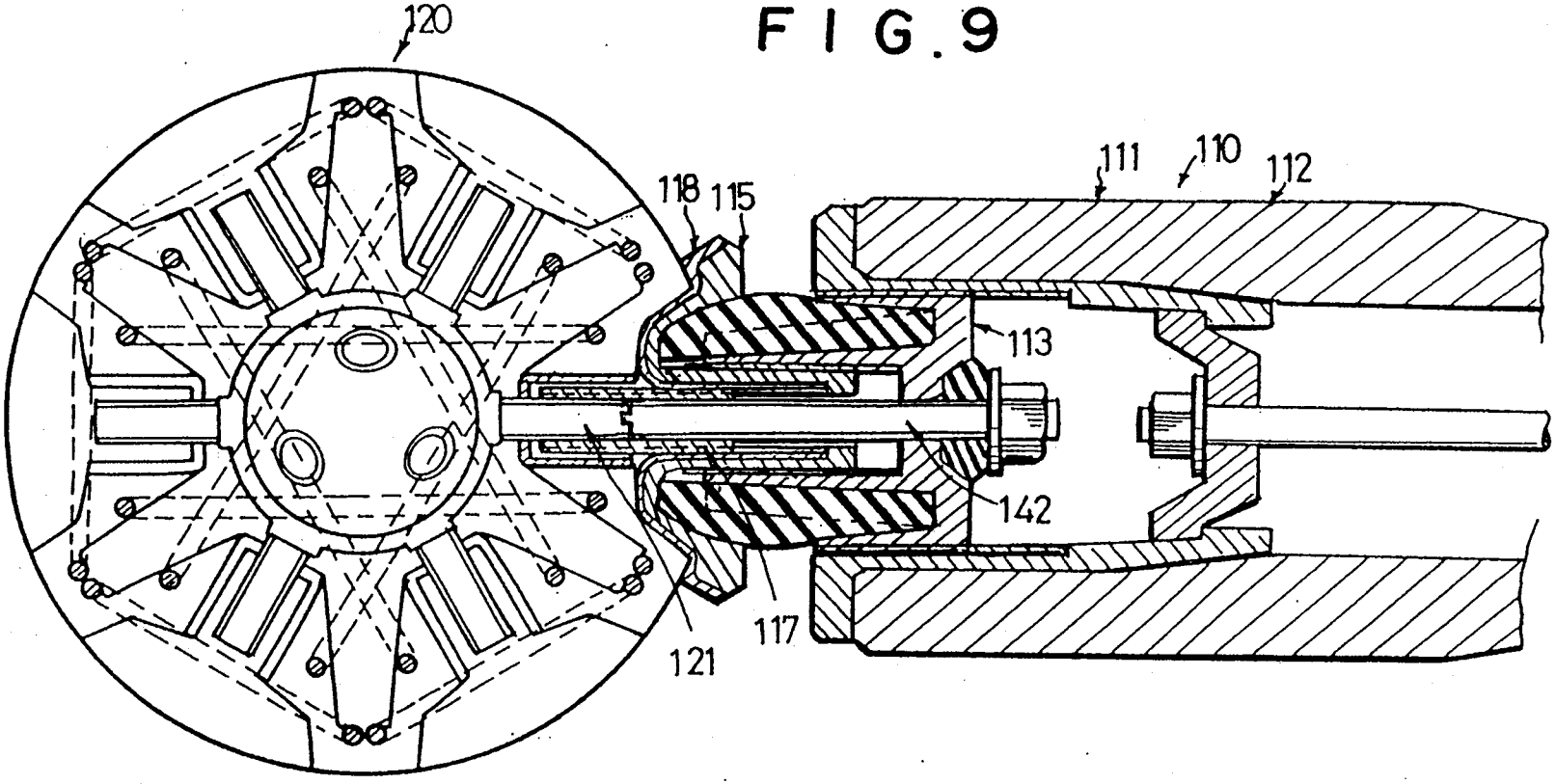
FIG. 9 is a view similar to FIG. 4 but showing the state in which the end piece of the tension rod is connected to the anchoring potion of the ball member.

In the state shown in FIG. 8, the second actuator 118 is rotated relative to the first actuator 115 to rotate the connecting member 117 relative to the end piece 142, thereby moving the connecting member 117 toward the ball member 120 relative to the end piece 142. As the connecting member 117 is projected toward the ball member 120 into the sleeve portion 123*b*, the thread 117*a* on the connecting member 117 is brought into engagement with the thread 121*a* on the anchoring potion 121, whereby the end piece 142 is connected to the anchoring portion 121 by the connecting member 117 as shown in FIG. 9. The shaft 110 can be removed from the ball member 120 by the reverse procedure.

The outer surfaces of the first and second actuators 115 and 118 are knurled in order to facilitate rotation thereof.

Though, in this embodiment, the connecting member 117 and the second actuator 118 are both mounted on the shaft 110, they may be mounted on the ball member 120.

Though, in this embodiment, each of the tubular member 110 and the tension rod 140 is divided into three pieces, it may be divided into two pieces. That is, each of the tubular member 110 and the tension rod 140 may have an end piece only at one end thereof. Further, each of the tubular member 110 and the tension rod 140 may by divided into more than three pieces.

Now a third embodiment of the present invention will be described with reference to FIGS. 10 to 15.

The underwater truss structure in accordance with the third embodiment of the present invention has a plurality of three-dimensional unit structures each of which is the same as that in the first embodiment in the combination of the shafts and the ball members but differs from that in the first embodiment in the structure of the shaft.

Figure 10:
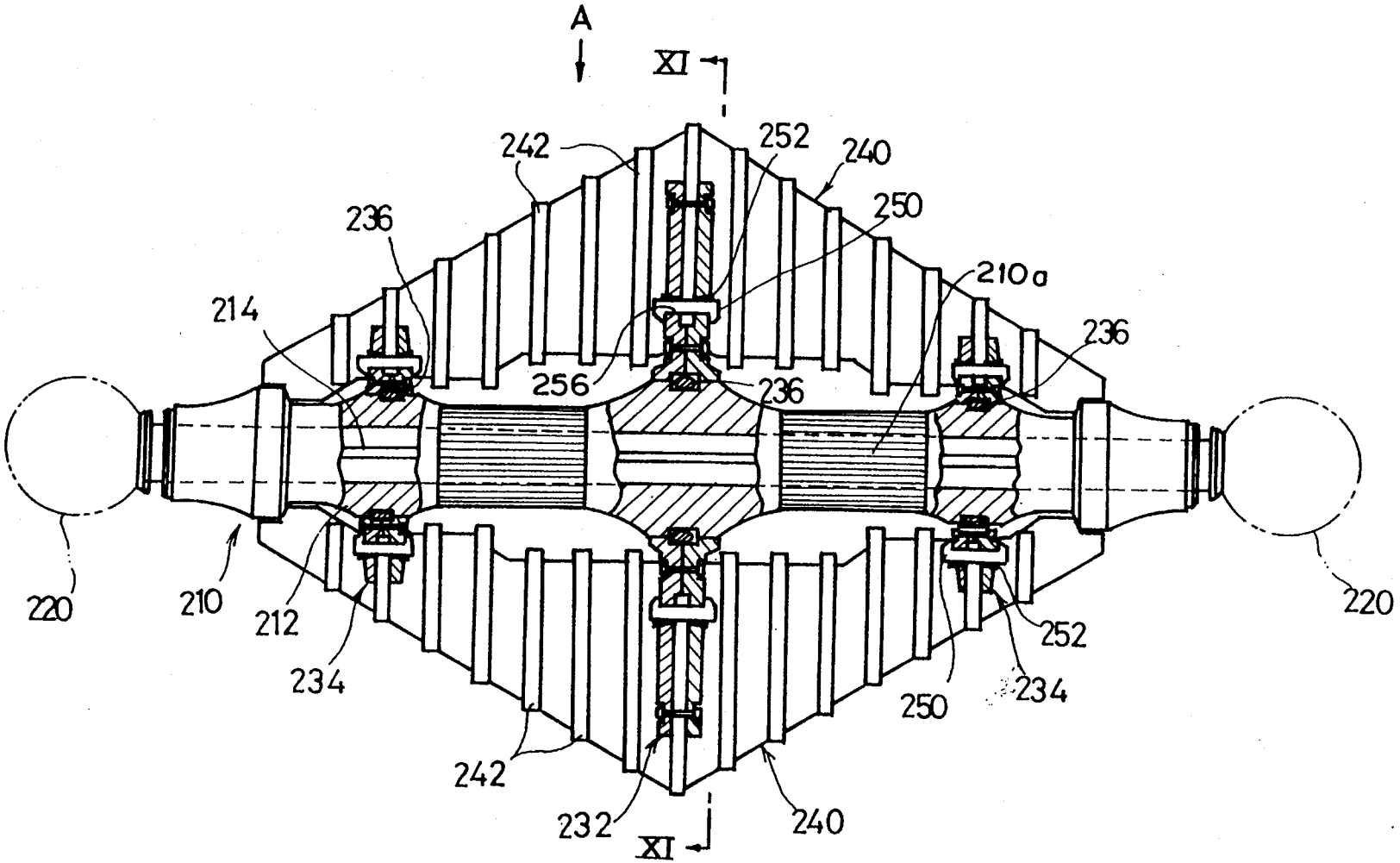
FIG. 10 is a view showing the shaft employed in a third embodiment of the present invention.

In FIG. 10, the shaft is indicated at 210 and the ball member is indicated at 220. As shown in FIG. 10, the shaft 210 comprises a tubular member 212 which resists a compression force and a tension rod 214 which extends through the tubular member 212 in the axial direction thereof and resists a tensile force. A plurality of protrusions 210*a* are formed on the outer surface of the tubular member 210 to extend in the longitudinal direction thereof. The protrusions 210*a* increases the contact area of the shaft 210 with the flow of water and the viscosity resistance against the flow of water and reduces the compressive resistance.

Figure 11:
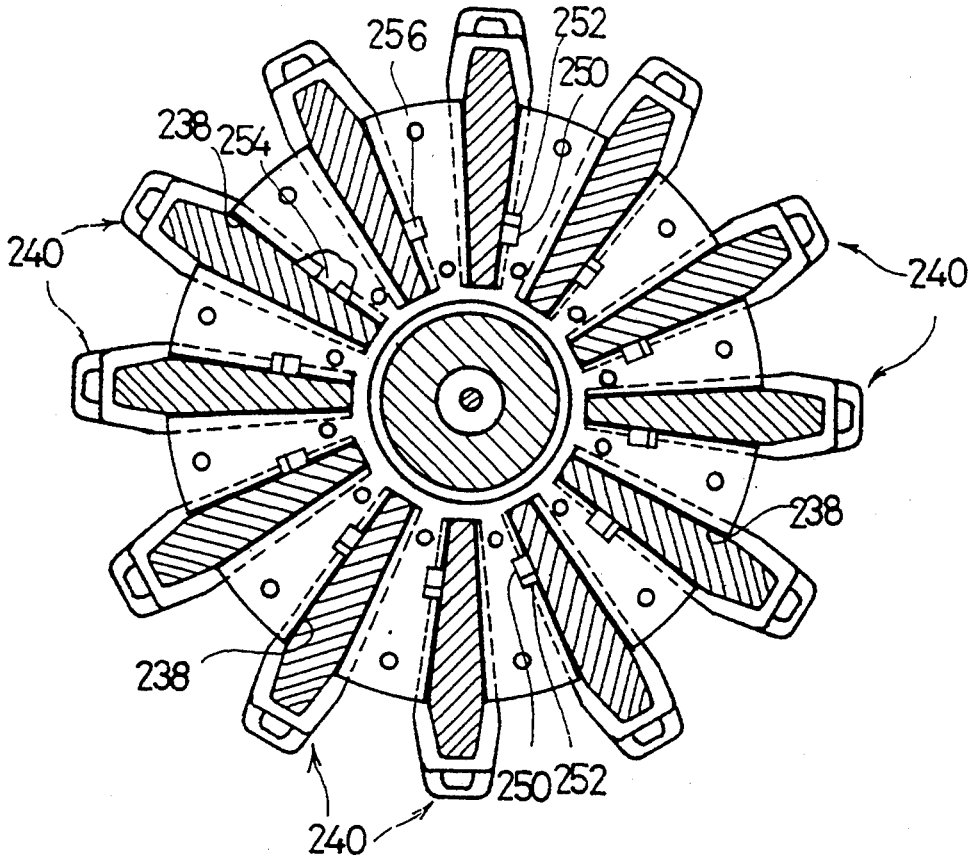
FIG. 11 is a cross-sectional view taken along line XI—XI in FIG. 10.
Figure 12:
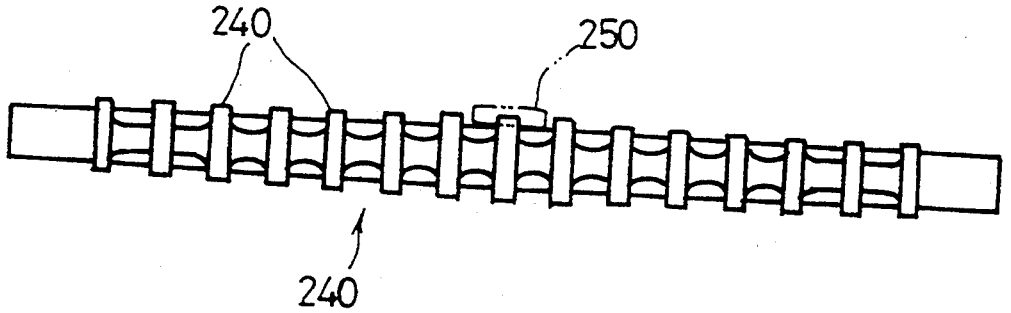
FIG. 12 is a view as viewed in the direction of arrow A in FIG. 10.

As shown in FIGS. 10 and 11, the shaft 210 is provided with a plurality of (twelve in this particular embodiment) arch wings 240 each of which extends from one end of the shaft 210 to the other end. The arch wing 240 is provided on its outer surface with a plurality of protrusions 242 extending in the radial direction of the shaft 210. As will be described in detail later, irregularities are formed on the surface of the arch wing 240.

The shaft 210 is provided with a large brim 232 at the middle between the ends and small brims 234 near the respective ends. Each of the brims 232 and 234 is formed by laminating a pair of identical plates and is resiliently mounted on the shaft 210 by way of a resilient packing 236. The structure of the connection between the shaft 210 and each brim is disclosed in Japanese Unexamined Patent Publication No. 1(1989)-180530 and accordingly will not be described in more detail here.

The arch wing 240 is mounted on the shaft 210 by way of the brims 232 and 234. That is, as shown in FIG. 11, the large brim 232 has a plurality of cutaway portions 238 each of which extends from the outer peripheral surface of the large brim 232 toward the center thereof and conforms to the cross-sectional shape of the arch wing 240. The small brims 234 are the same as the large brim 232 in structure. As can be understood from FIG. 10, the arch wing 240 is inserted into the cutaway portions 238 in the large brim 232 and the small brims 234 along the portions provided with the protrusions 242 and accordingly, the cutaway portion 238 in each brim is shaped to conform to the cross section of the arch wing 240 along the corresponding protrusion 242.

Connection of the arch wing 240 will be described in conjunction with the large brim 232, hereinbelow. The arch wing 240 is connected to the small brims 234 in the similar way. First the brims 232 and 234 are mounted on the shaft 210 in a predetermined position. Then the arch wing 240 is inserted into the cutaway portions 238 in each brim. Then the arch wing 240 is fixed to the brim by means of a connecting member 250 and a wedge 252.

That is, as can be seen from FIGS. 10 and 11, a recess is formed on opposite sides of each of the cutaway portions 238 and when the arch wing 240 is inserted into the cutaway portion 238, the protrusions 242 on opposite sides of the arch wing 240 are respectively received in the recesses and a notch 254 formed in each protrusion 242 is aligned with a pair of holes 256 formed in the plates forming the brim 232. Then the connecting member 250 is passed through the holes 256 and the notch 254 and is fixed there by the wedge 152, thereby preventing the arch wing 240 from being drawn out the cutaway portion 238.

The arch wings 240 increase the contact area with water per unit volume of the underwater truss structure and promotes the cascade type divisions, thereby increasing the wave damping effect of the underwater truss structure.

Further the arch wings 240 prevent the brims 232 and 234 from being displaced in the longitudinal direction of the shaft 210. Accordingly, the brims 232 and 234 can be resiliently mounted on the shaft 210 without fear of displacement in the longitudinal direction of the shaft 210 due to pressure of water. As described above, it is preferred that the brims be resiliently mounted on the shaft 210 so that an excessive bending moment does not act on the shaft 210.

On the other hand, the brims 232 and 234 function as reinforcement which prevents the arch wings 240 from being displaced in the circumferential direction of the shaft 210. Thus the combination of the arch wings 240 and the brims 232 and 234 makes the arch wings 240 structurally stable. The arch wings 240 and the brims 232 and 234 not only contribute to increase in the contact area with water of the structure but complement each other.

Further the arch wings 240 function also as reinforcement for the shaft 210 against axial forces, bending forces and the like. That is, since the end portions of each arch wing 240 are in abutment against the end portions of the shaft 210, more strictly, the end portions of the arch wing 240 are in engagement with flange-like protrusions formed on the end portions of the shaft 210 as shown in FIG. 10, the arch wings 240 can resist axial forces and bending forces acting on the shaft 210, thereby preventing the shaft 210 from being applied with an excessive axial stress or an excessive bending stress.

Now the irregularities formed on the surface of the arch wing 240 will be described, hereinbelow.

Figure 13:
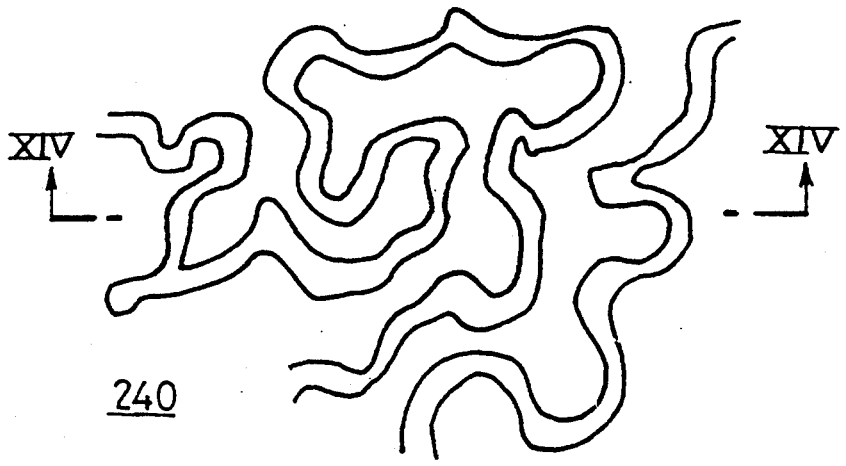
FIG. 13 is a schematic view showing the irregularities formed on the surface of the arch wing.
Figure 14:
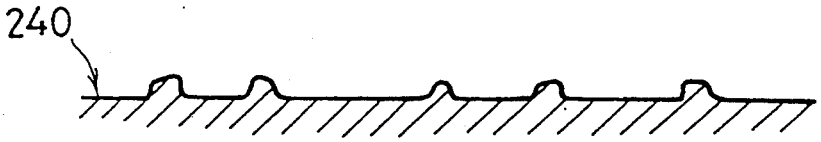
FIG. 14 is a cross-sectional view taken along line XIV—XIV in FIG. 13.

As shown in FIGS. 13 and 14, continuous winding protrusions are formed on the surface of the arch wing 240, thereby forming irregularities thereon. Such irregularities contribute to increase in the contact area with water of the arch wing 240 and the viscosity resistance against the flow of water, thereby reducing the compressive resistance. Such irregularities may be formed providing continuous winding recesses on the surface of the arch wing 240 instead of protrusions. Further, in place of continuous protrusions or recesses, a plurality of spot-like projections or recesses may be formed on the surface of the arch wing 240. Further, such irregularities may be formed on the surfaces of the brims 232 and 234.

When the three-dimensional unit structures of this embodiment comprising a plurality of ball members 220 and a plurality of shafts 210 with brims 232 and 234 and arch wings 240 are employed as elements of an underwater truss structure, the scale of the overall underwater truss structure can be reduced, for instance, as follows.

Figure 15:
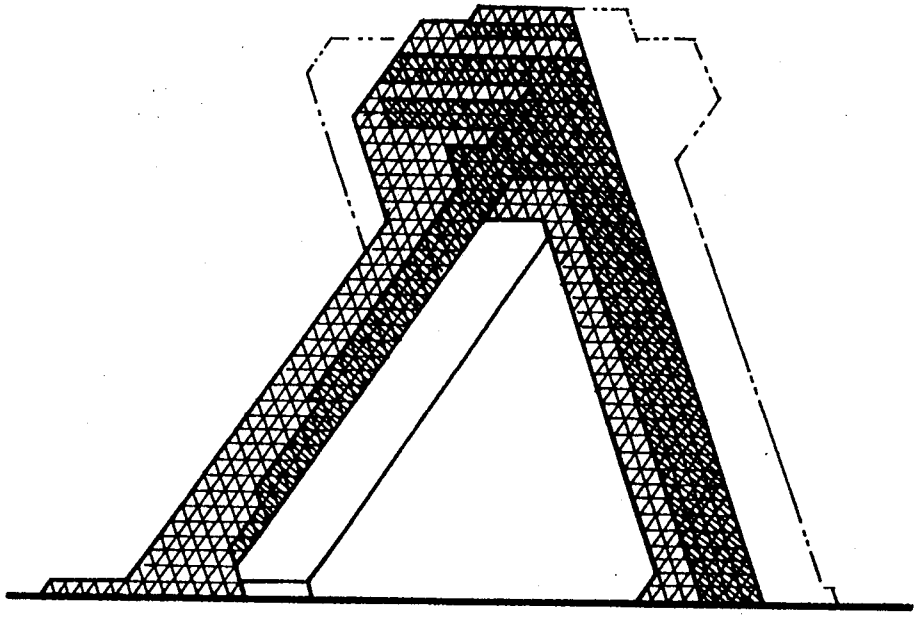
FIG. 15 is a schematic view showing an example of an arrangement when the underwater truss structure of the third embodiment is used as a breakwater.

Assuming that a breakwater is installed on a Pacific ocean floor at a depth of 60 to 70 m, it is estimated that the scale of the breakwater should be as shown by the chained line in FIG. 15 (in which small triangles respectively represent three-dimensional unit structures) in order to obtain a desired wave damping effect when the breakwater is formed solely of brimmed three-dimensional unit structures in which each of the shafts is provided with three brims. In contrast, when the hatched portion is formed of the three-dimensional unit structures of the third embodiment having the three brims and twelve arch wings, it is estimated that the scale of the breakwater may be as shown by the solid line in FIG. 15. Thus with the three-dimensional unit structures with the brims and the arch wings, the scale of the underwater truss structure can be smaller for a given desired wave damping effect.

Now a fourth embodiment of the present invention will be described with reference to FIGS. 16 to 20.

The underwater truss structure in accordance with the fourth embodiment of the present invention has a plurality of three-dimensional unit structures each of which is the same as that in the first embodiment in the combination of the shafts and the ball members but differs from that in the first embodiment in the structure of the shaft. In the fourth embodiment, the elements analogous to those in the third embodiment are given the same reference numerals and will not be described in detail here.

Figure 16:
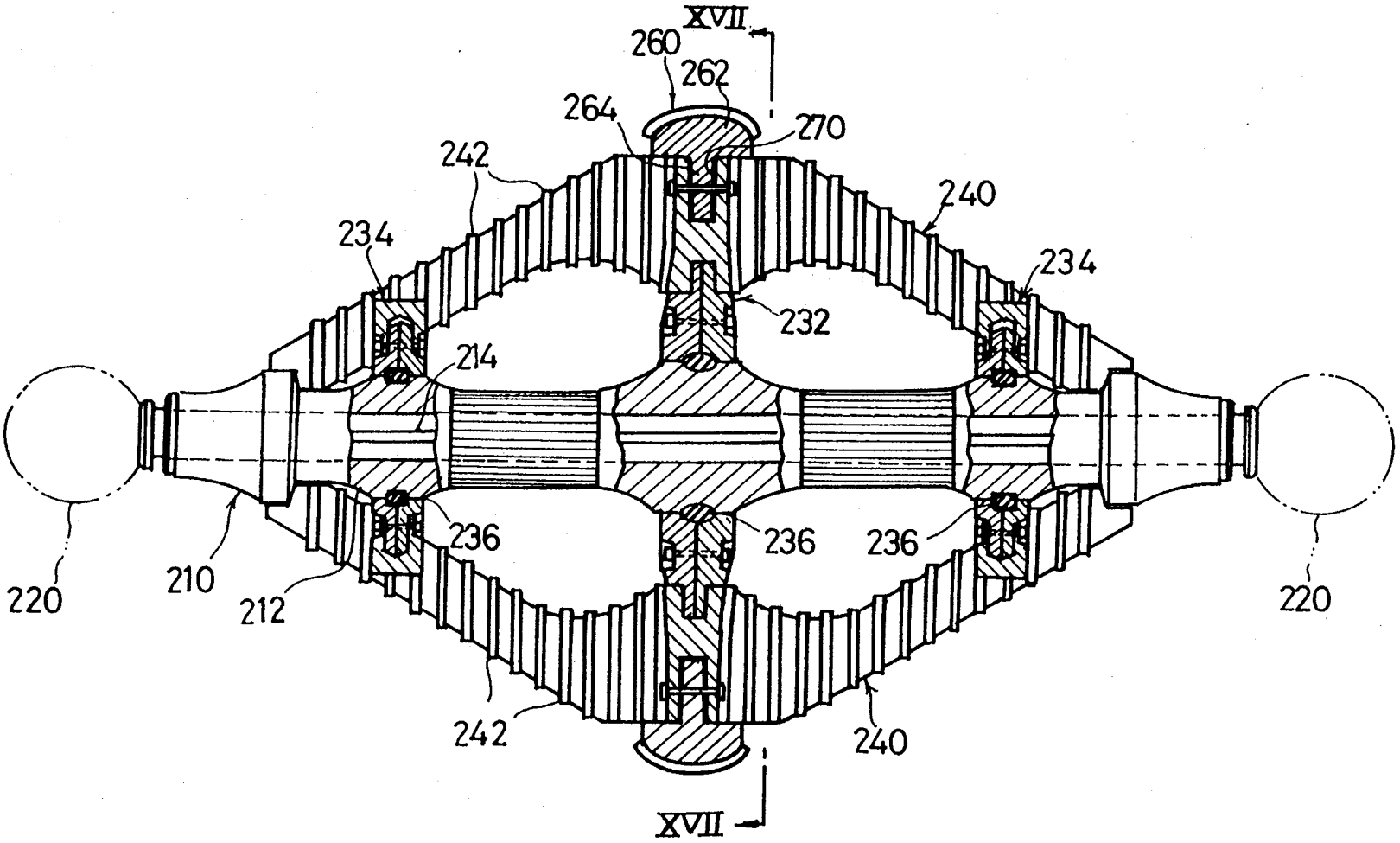
FIG. 16 is a view similar to FIG. 10 but showing the shaft employed in a fourth embodiment of the present invention.
Figure 17:
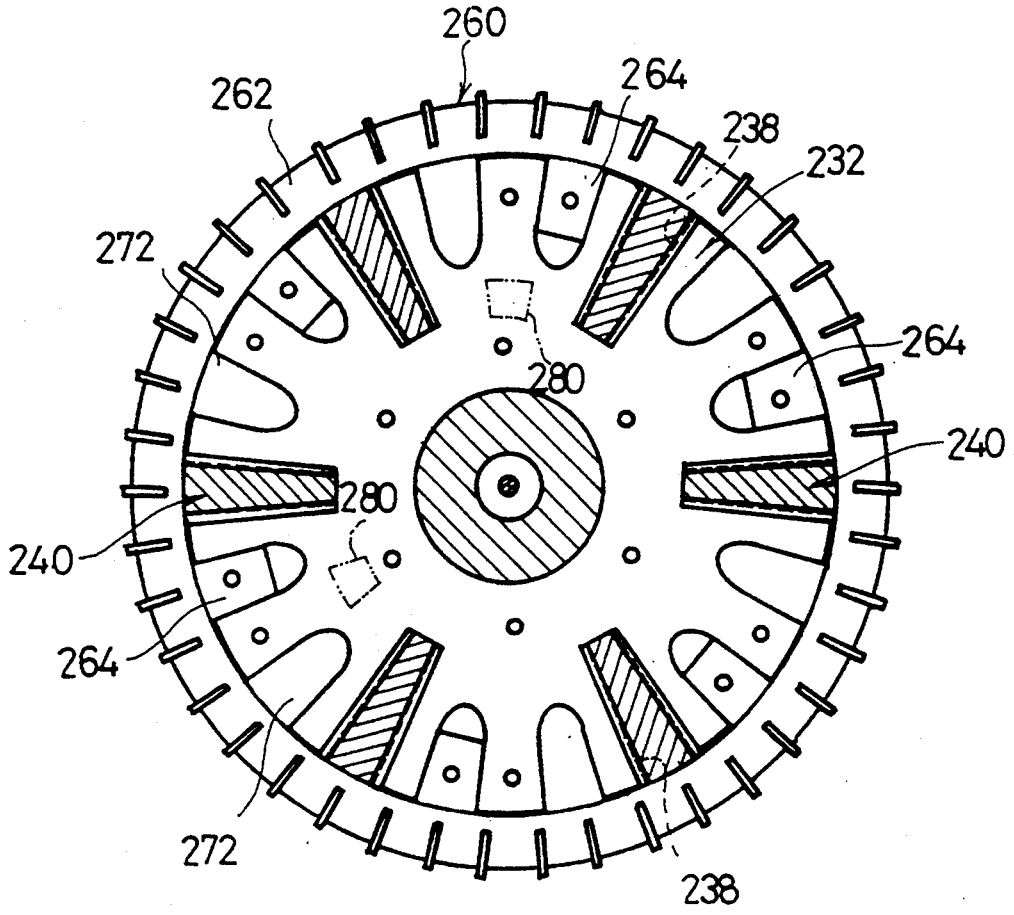
FIG. 17 is a cross-sectional view taken along line XVII—XVII in FIG. 16.

As can be seen from FIGS. 16 and 17, the shaft 210 employed in this embodiment is provided with six arch wings 240 at regular intervals in the circumferential direction thereof. Each arch wing 240 extends from one end of the shaft 210 to the other end. The shaft 210 is further provided with a large brim 232 at the middle between the ends and small brims 234 near the respective ends.

The arch wings 240 and the brims 232 and 234 are basically the same in structure as those in the third embodiment though somewhat different from those in the third embodiment in shape and the like. The fourth embodiment differs from the third embodiment mainly in the manner of fixing the arch wings 240 to the brims 232 and 234, or in the manner of preventing the arch wings 240 from being removed from the brims 232 and 234. That is, though, in the third embodiment, each arch wing 240 is fixed to the brims by means of the connecting member 250 and the wedge 252, it is fixed to the shaft 210 by means of a ring 260 fitted on the large brim 232.

As shown in FIGS. 16 and 17, the ring 260 comprises an annular main body 262 having an inner diameter substantially equal to the outer diameter of the large brim 232 and a plurality of engaging projections 264 radially projecting inward from the inner peripheral surface of the main body 262 at regular intervals. The large brim 232 is provided with a plurality of engaging recesses 270 adapted to be engaged with the respective engaging projections 264 and a plurality of introduction cutaway portions 272 which communicated with the engaging recesses 270 and open in one side of the brim 232. After the arch wings 240 are inserted into the cutaway portions 238 of the large brim 232, the ring 260 is moved toward the large brim 232 in the longitudinal direction of the shaft 210 so that the engaging projections 264 are respectively received in the introduction cutaway portions 272 and the main body 262 is fitted on the large brim 232, and then the ring 260 is rotated so that the engaging projections 264 are engaged with the engaging recesses 270. A plurality of protrusions are formed on the outer peripheral surface of the ring 260 at regular intervals.

Figure 18:
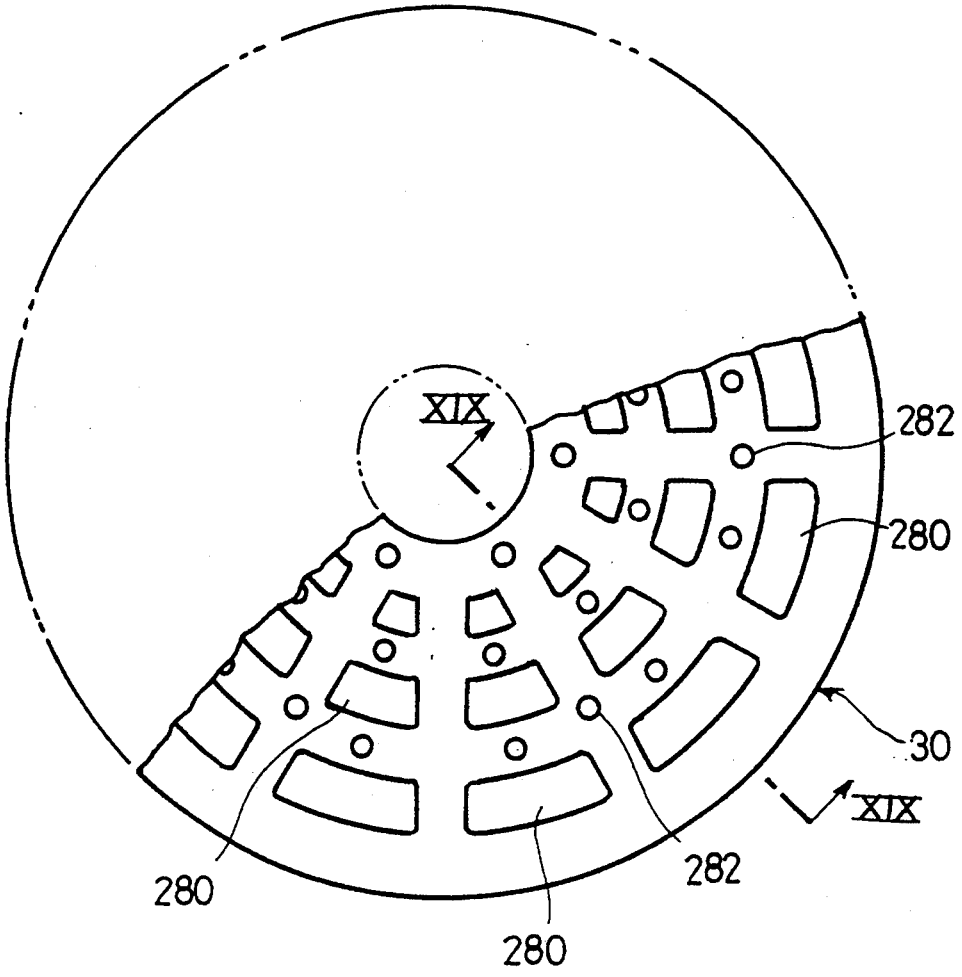
FIG. 18 is a plan view showing the layout, shape and the like of through holes to be formed in the brim.
Figure 19:
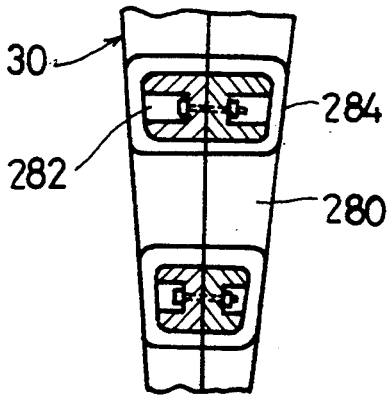
FIG. 19 is a cross-sectional view taken along line XIX—XIX in FIG. 18.
Figure 20:
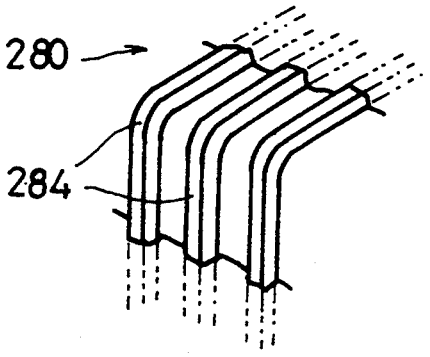
FIG. 20 is a fragmentary perspective view showing in detail a part of the through hole.

Further, as shown in FIGS. 18 to 20, the 30 may be provided with a plurality of through holes 280. Reference numeral 282 denotes a bolt hole. Though the brim 30 shown in FIG. 18 is circular, the brims 232 and 234 combined with the arch wings 240 may also be provided with the similar through holes as shown by the chained line in FIG. 17. Further as shown in FIGS. 19 and 20, a plurality of parallel protrusions 284 may be provided inside the through holes 280 and/or in the vicinity thereof.

When the brim is provided with such through holes 280, water passes through the through holes 280 and the flow of water is more effectively led to a turbulent state when the flow rate of water is low. When the flow rate of water is high, the through holes 280 prevent the surface of the brim 230 from being damaged by cavitation. Also the arch wings may be provided with the similar through holes.

What is claimed is:

1. An underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod extending inside the tubular member in the axial direction thereof, characterized in that said tubular member is divided into a plurality of tubular pieces in the longitudinal direction thereof, said tubular pieces comprising a main body and a tube end piece at each end thereof, the main body being movable relative to each tube end piece in the longitudinal direction of the tubular member and the overall length of the tubular member can be varied by moving the portions of the tube end pieces relative to end portions of the main body in the longitudinal direction of the tubular member, and said tension rod is divided into a plurality of rod pieces in the longitudinal direction thereof the rod pieces comprising a main rod and rod end pieces which are respectively connected to portions of said tubular member which are relatively movable with respect to each other.

2. An underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod wherein means are provided for interconnecting said tension rods of the shafts through the center of the ball member without being directly connected to said ball member, such that said ball member is free of tension forces acting between said tension rods.

3. An underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod extending inside the tubular member in the axial direction thereof, characterized in that an end portion of the tension rod is movable relative to the tubular member in the longitudinal direction thereof to be retracted in the tubular member and to be projected from the end of the tubular member and the end portion of the tension rod extends into the ball member and is connected to a connecting means provided in the ball member;

wherein said connecting means releasably holds the end portion of the tension rod; and wherein said the connecting means comprises a pair of engaging pieces which are provided on the end portion of the tension rod to be movable toward and away from each other respectively to a closed position and an open position and a sleeve member which is provided inside the ball member and into which the end portion of the tension rod is inserted, the sleeve member having a small diameter portion at its outer end with an engaging shoulder formed between the larger diameter portion and the small diameter portion, and said engaging pieces permitting the end portion of the tension rod to be freely inserted into and drawn out of the sleeve member when they are in the closed position and engaging with said engaging shoulder to prevent the end portion of the tension rod to be drawn out of the sleeve member when they are in the open position.

4. An underwater truss structure as defined in claim 3 in which said engaging pieces can be controlled from outside the shaft by means of an actuator at least a part of which is exposed outside the shaft so that the position of the engaging pieces can be known from outside on the basis of the state of the part.

5. An underwater truss structure formed by continuously linking a plurality of unit structures each of which comprises a plurality of shafts and ball members assembled so as to form a triangle with the ball members respectively positioned at the vertexes of the triangle to connect the shafts at their ends, the shaft comprising a compression-resistant tubular member and a tension-resistant tension rod extending inside the tubular member in the axial direction thereof, characterized in that said tubular member comprises a main body and an end piece which is connected to the main body to be movable relative to the main body in the longitudinal direction of the tubular member, said tension rod comprises a main body and an end piece which are respectively connected to the main body and the end piece of the tubular member, said ball member comprises an abutment portion which abuts against the end face of the end piece of the tubular member to position the end piece relative to the ball member and support the shaft against a compression force, and an anchoring portion which extends in the ball member and is connected to the end piece of the tension rod to support the tension rod against a tensile force, and there are provided a connecting member which is mounted on one of the end piece of the tension rod and the anchoring portion to be movable relative thereto in the longitudinal direction thereof and an actuator which is operatively connected to the connecting member at one end and the other end of which projects outside between the abutment portion of the ball member and the end piece of the tension rod in the state where they are in abutment against each other.

6. An underwater truss structure as defined in claim 5 in which said connecting member is mounted on the end piece of the tension rod to be movable relative thereto in the longitudinal direction thereof, and is moved toward the anchoring portion when it connects the end piece of the tension rod to the anchoring portion.

7. An underwater truss structure as defined in claim 6 in which said actuator is mounted on the outer end portion of the end piece of the tubular member to be rotatable about the axis of the end piece relative thereto, and said connecting member is moved relative to the end piece of the tension rod in response to rotation of the actuator relative to the end piece of the tubular member.

8. An underwater truss structure as defined in claim 6 or 7 in which said actuator is shaped to surround the outer end portion of the end piece of the tubular member and is adapted to be displaced relative to the end piece of the tubular member in the longitudinal direction thereof, a resilient member intervening between the end piece of the tubular member and the actuator.

9. An underwater truss structure as defined in claim 5 in which said end piece of the tension rod is provided with a thread on its outer peripheral surface, said anchoring portion of the ball member is provided on its outer peripheral surface with a thread which is the same as the thread on the end piece of the tension rod, said connecting member is in the form of a tubular member which has on its inner peripheral surface a thread adapted to be engaged with the threads on the end piece of the tension rod and the anchoring portion and is held on the end piece of the tension rod by way of engagement between the thread thereon and the thread on the end piece of the tension rod, the connecting member connecting the end piece of the tension rod to the anchoring portion of the ball member by engaging with both the threads on the end piece of the tension rod and the anchoring portion of the ball member, and said actuator is shaped to surround the outer end portion of the end piece of the tubular member and mounted thereon to be rotatable relative thereto, said connecting member being rotated relative to the end piece of the tension rod in response to rotation of the actuator relative to the end piece of the tubular member, thereby moved relative to the end piece of the tension rod in the longitudinal direction thereof.

10. An underwater truss structure as defined in claim 9 in which said actuator is connected to the connecting member to transmit only its rotation and to be able to be displaced relative to the connecting member and the end piece of the tubular member in the longitudinal direction, a resilient member intervening between the actuator and the end piece of the tubular member.

11. An underwater truss structure as defined in claim 7 or 9 in which said main body of the tubular member has a recess on one end thereof, the recess having a cylindrical inner surface extending in the longitudinal direction of the tubular member and a thread being provided on the inner surface of the recess, and said end piece of the tubular member is provided on its outer surface with a thread adapted to be engaged with the thread on the inner surface of the recess and is moved in the longitudinal direction main body by rotating the end piece relative to the main body.

12. An underwater truss structure as defined in any one of claims 1,2 or 5 in which said shaft is provided with a plurality of arch wings arranged in the circumferential direction thereof, each of the arch wings extending arcuately from one end of the shaft to the other end in a plane passing through the central axis of the shaft.

13. An underwater truss structure as defined in claim 12 in which said shaft is provided with a brim which extends substantially in perpendicular to the central axis of the shaft and said arch wings are connected to the brim.

14. An underwater truss structure as defined in claim 12 in which said shaft is provided with a reinforcement which extends between the arch wings in a plane substantially perpendicular to the central axis of the shaft and suppresses displacement of the arch wings in the circumferential direction of the shaft.

15. An underwater truss structure as defined claim 12 in which irregularities in the form of continuous lines or spot patterns are formed on the surface of the arch wings.

16. An underwater truss structure as defined in claim 13 in which said shaft is provided with a reinforcement which extends between the arch wings in a plane substantially perpendicular to the central axis of the shaft and suppresses displacement of the arch wings in the circumferential direction of the shaft.

17. An underwater truss structure as defined claim 14 in which irregularities in the form of continuous lines or spot patterns are formed on the surface of the arch wings.

18. An underwater truss structure as defined claim 2, wherein said tension rods are connected together by a tension block disposed within an inner space of the ball member and to which ends of the tension rods are connected.

19. An underwater truss structure as defined claim 18, wherein said tension block has anchoring portions which project from said inner space through a surrounding wall of said ball member, each said anchoring portion being connected to the end of a respective one of the tension rods.

* * * * *